United States Patent [19]

Catania

[11] 4,122,577

[45] Oct. 31, 1978

[54] GOLF SHOE WIPING ATTACHMENT FOR GOLF CLUB HEADS

[76] Inventor: Salvadore Catania, 67 Wall St., New York, N.Y. 10005

[21] Appl. No.: 699,251

[22] Filed: Jun. 24, 1976

[51] Int. Cl.[2] ..... A46B 17/02; A63B 57/00

[52] U.S. Cl. ..... 15/160; 15/210 R; 36/127

[58] Field of Search ..... 15/112, 160, 161, 237, 15/246; 36/96, 107, 114, 126, 127, 132, 133; 273/32 R, 32 B, 32 C, 187 B

[56] References Cited

U.S. PATENT DOCUMENTS

| | | | |
|---|---|---|---|
| 114,847 | 5/1871 | Osborne | 15/161 |
| 414,145 | 10/1889 | Cyrenius | 15/161 |
| 788,232 | 4/1905 | Addison | 15/423 |
| 1,224,655 | 5/1917 | Lloyd | 36/107 X |
| 1,515,665 | 11/1924 | Eck | 36/132 |
| 1,760,815 | 5/1930 | Cazel | 15/112 |
| 2,220,291 | 11/1940 | Savoy | 36/127 X |
| 2,615,188 | 10/1952 | Siegel | 15/237 X |
| 3,218,734 | 11/1965 | O'Brien | 36/133 |

FOREIGN PATENT DOCUMENTS

| | | | |
|---|---|---|---|
| 1,093,792 | 11/1954 | France | 15/237 R |

*Primary Examiner*—Daniel Blum

[57] ABSTRACT

In the driving of golf clubs, particularly on moist ground, divots and muddy earth are met by the driving head of the club and attached thereto, requiring removal repeatedly. This has meant in the past the carrying by the golfer of a wiping cloth and its use to clean the driving head of the club and which is time-taking and requires the golfer to handle a progressing dirty cloth. By means of the present invention, the golfer's shoe, either right or left, is provided with a plate, held by two or more of standard pointed shoe spikes, the plate carrying a wiping element for the club head, and with a simple sweep-movement of the club its head is quickly cleaned with ease. The wiping element may be of brush form or a relatively soft upstanding element such as fabric.

2 Claims, 3 Drawing Figures

GOLF SHOE WIPING ATTACHMENT FOR GOLF CLUB HEADS

The Invention will be described with reference to the accompanying drawings, in which.

Figure 1:
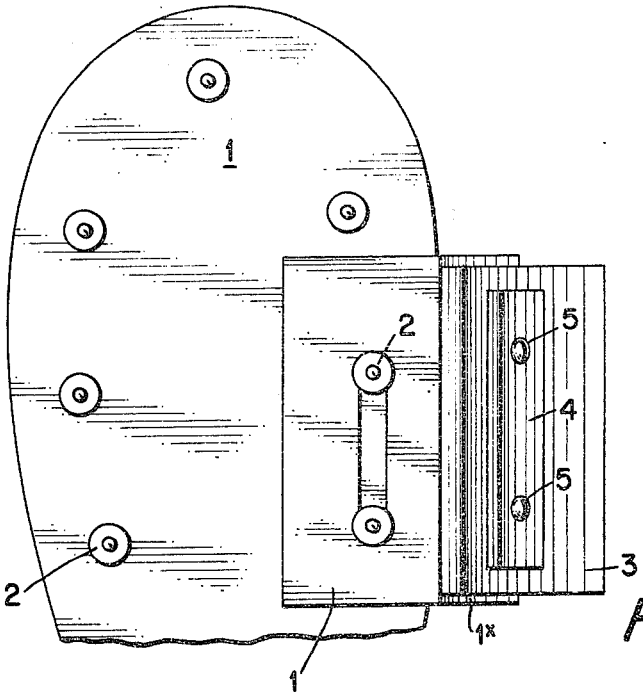
FIG. 1 is a plan view of the sole area of a golfers shoe carrying a wiping attachment.

Referring to FIG. 1, it will be seen that for the purpose of illustration the golf head wiping assembly of the invention is shown in reverse position in the sense that the lower face of the shoe sole is exposed and the wiping assembly shown attached thereto with the wiping element extending downwardly opposite its position when in use. The assembly shown comprises a plate 1 having an integral inclined extension 1$^x$ which normally extends upwardly. The plate 1 is formed with a slot of a width and length to receive and be frictionally held by two of the golf shoe spikes 2. Carried by the angular extension of plate 1 is shown a wiping member 3 which is shown as a pad like form and which will be made of relatively soft material and preferably unitary and cushion-like, as are several types of soft plastics well known currently.

As well known by golfers the position and spacing of the spikes on a golfer's shoe is standard. The spikes being tapered, therefore the slot in the wiping construction as shown in FIG. 1 is firmly engaged by two spikes.

To releasably hold the wiping member on the plate extension 1$^x$ is shown a small, preferably aluminum clamp-strip 4. In practice the plate extension may be formed with spaced internally threaded apertures to hold headed screws 5, the heads of the screws abutting the said strip 4. By the use of an aluminum alloy for the element 1, 1$^x$ and the strip 5, the assembly shown will be light, firmly held on the golfer's shoe, and at the same time readily releasable.

Figure 2:
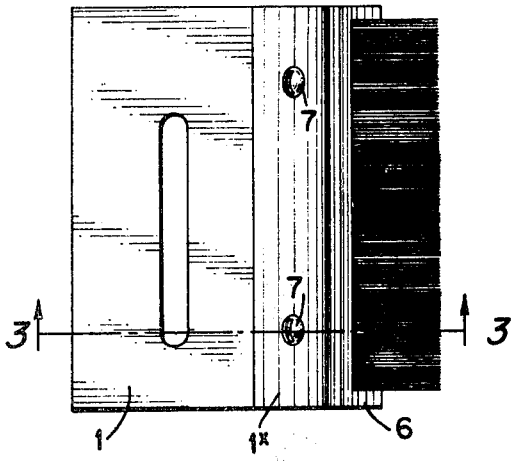
FIG. 2 is a plan view of another form of the invention, showing a brush element awaiting assembly.
Figure 3:
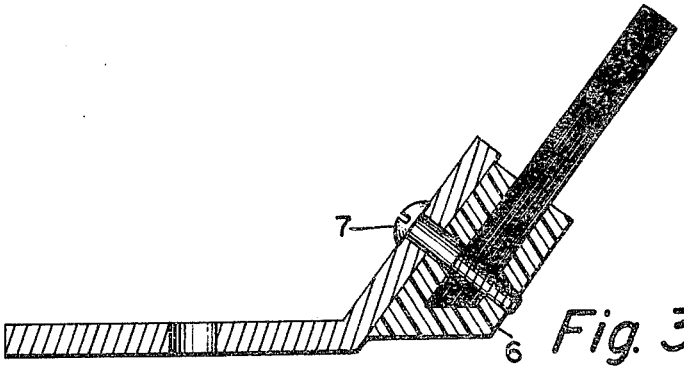
FIG. 3 is a cross-section of FIG. 2 on the line 3—3.

FIG. 2 illustrates the assembly in position to be applied to the golf shoe with its sole down. The golf club wiping element is shown at 6 with respect to its base portion which carries the brush and holds it in position. This base member receives one or more elements holding it to the angular member 1$^x$ of the plate 1, in this form they are screws indicated at 7. Obviously, the angular member 1$^x$ may be modified by having a pocket form at the angular member 1$^x$ adapted to receive and adequately hold the base of the brush, enabling removal and positioning the brush without preliminary removal of such means as screws, or the like.

Various modifications may be made in the form and arrangements of elements shown in the drawings, within the spirit of the invention and the following claims. Thus while the elongated slot in plate element 1 may be substituded by individual round apertures each to receive and hold one of the golf shoe spikes, it also may be shaped as desired, as for example, with curved marginal edges even to the point of covering the entire sole area of the golf shoe, the slots as shown in element 1, or individual spike receiving openings being positioned to receive the spikes, the latter customarily being standard in position and spacing. Also in FIG. 2, at 6 a pocket may be carried by the plate extension and of such receiving area as to frictionally hold a wiping element.

Having described my invention, what I claim and desire to protect by Letters Patent is as follows:

1. A wiping attachment adapted to be attached to a golfer's shoe for cleaning golf club heads, comprising a plate formed with an elongated slot of such length and width to receive and to be frictionally held by two spaced spikes projecting from the underside of a golfer's shoe, said plate carrying at one side an upwardly and outwardly extending holding plate that would project at an incline away from the golfer's shoe, a wiping element, and means to secure the wiping element to the outer face of said holding plate with a portion of the wiping element extending thereabove, the wiping element being operative to clean a golf club head by a sweeping movement of the head against the same.

2. A wiping attachment according to claim 1 in which the wiping element is a brush.

* * * * *